US008667621B2

(12) United States Patent
Hashimoto et al.

(10) Patent No.: US 8,667,621 B2
(45) Date of Patent: Mar. 11, 2014

(54) SANITARY WASHING APPARATUS

(75) Inventors: Hiroshi Hashimoto, Kitakyushu (JP); Minoru Sato, Kitakyushu (JP)

(73) Assignee: Toto Ltd., Fukuoka (JP)

( * ) Notice: Subject to any disclaimer, the term of this patent is extended or adjusted under 35 U.S.C. 154(b) by 833 days.

(21) Appl. No.: 12/893,452

(22) Filed: Sep. 29, 2010

(65) Prior Publication Data

US 2011/0072572 A1 Mar. 31, 2011

(30) Foreign Application Priority Data

Sep. 30, 2009 (JP) ..... 2009-228657
Sep. 30, 2009 (JP) ..... 2009-228660

(51) Int. Cl.
*A47K 4/00* (2006.01)

(52) U.S. Cl.
USPC ..... 4/420.2; 4/420.4; 4/433

(58) Field of Classification Search
USPC ..... 4/433, 444, 447, 420.2, 420.4, 420.5
See application file for complete search history.

(56) References Cited

U.S. PATENT DOCUMENTS 5,826,282 A 10/1998 Matsumoto et al.
6,754,912 B1 6/2004 Hayashi et al.
7,191,473 B2 * 3/2007 Matsumoto et al. ..... 4/420.2
8,082,607 B2 * 12/2011 Matsushita et al. ..... 4/420.5
8,495,770 B2 * 7/2013 Koga et al. ..... 4/420.4
2005/0229301 A1 10/2005 Hassan

FOREIGN PATENT DOCUMENTS

DE 198 26 280 A1 12/1999
DE 201 13 813 U1 3/2002
JP 2001-311201 A 11/2001
JP 2002-155565 A 5/2002
JP 2002-155567 A 5/2002
JP 2007-270564 A 10/2007
JP 2008-291491 A 12/2008
WO 2010/092911 A1 8/2010

OTHER PUBLICATIONS

The Extended European Search Report dated Nov. 22, 2011; EP Application No. / Patent No. 10251700.0/2315/ 2312070.

* cited by examiner

*Primary Examiner* — Huyen Le
(74) *Attorney, Agent, or Firm* — Studebaker & Brackett PC

(57) ABSTRACT

A sanitary washing apparatus includes a nozzle having jetting water outlets from which water that pulsates by cyclically changing pressure jets, and a pump and a controller that functions as a flowing water adjuster that adjusts flowing water fed to the jetting water outlets in such a manner that first jetting water and second jetting water alternately occur at peaks of the pulsation of the water. With such an arrangement the first jetting water hits an anus and the private parts of a human body in a smaller area with a higher density than the second jetting water, and the second jetting water hits the anus and the private parts in a larger area with a lower density than the first jetting water.

11 Claims, 10 Drawing Sheets

SANITARY WASHING APPARATUS

CROSS-REFERENCE TO RELATED APPLICATION

This application claims benefit under 35 U.S.C. .sctn.119 (a) of Japanese Patent Application No. 2009-228657, filed on Sep. 30, 2009, and Japanese Patent Application No. 2009-228660, filed on Sep. 30, 2009, in the Japan Patent Office, the entire contents of which are incorporated herein by reference.

BACKGROUND OF THE INVENTION

1. Field of the Invention

The present invention relates to a sanitary washing apparatus for washing an anus and the private parts of a human body.

2. Description of the Related Art

Sanitary washing apparatuses are required to give a user a comfortable wash feeling with a minimum amount of water and are under development to meet the requirement. More specifically, the comfortable wash feeling is a feeling that combines an enough feeling (a feeling that the amount of water used for washing is enough) and a pungent feeling (a feeling that the intensity of the water used for washing is enough).

For example, a sanitary washing apparatus described in Japanese Patent Laid-Open No. 2002-155567 (referred to as Patent Document 1 hereinafter) is provided with an orifice part that has an outlet directed toward an anus and the private parts of a human body so that wash water hits the anus and the private parts without interruption. This arrangement contributes to producing the pungent feeling during washing. In addition, the sanitary washing apparatus has an air inlet in the vicinity of the orifice part and takes air in through the air inlet by the ejector effect. The air taken in is used to disturb the surface of the jetting wash water to vary the density of the water jet, thereby producing the enough feeling during washing.

SUMMARY OF THE INVENTION

However, the conventional technique described above is of a naturally-aspirated type that takes air in by the ejector effect, and the amount of air mixed with the wash water or the timing of mixing of air with the wash water varies. As a result, the density of the wash water jetting from the orifice part irregularly varies to make the user have an uncomfortable feeling or an intermittent feeling when the wash water hits the anus and the private parts.

The present invention has devised in view of such problems of the conventional technique described above, and an object of the present invention is to provide a sanitary washing apparatus that produces a comfortable wash feeling that combines an enough feeling and a pungent feeling with a small amount of water while reducing an uncomfortable feeling and an intermittent feeling caused by water nonuniformly hitting an anus and the private parts of a human body.

To attain the object described above, a sanitary washing apparatus according to the present invention is a sanitary washing apparatus that jets water to an anus and the private parts of a user from a jetting water outlet of a nozzle comprises: the nozzle having the jetting water outlet from which water that pulsates by cyclically changing pressure jets; and a flowing water adjuster that adjusts flowing water fed to said jetting water outlet in such a manner that first jetting water and second jetting water alternately occur at peaks of the pulsation of the jetting water. Said first jetting water hits the anus and the private parts in a first area with a first density, and said second jetting water hits the anus and the private parts in a second area with a second density. Said first density is higher than said second density, and said first area is smaller than said second area.

Since the first jetting water hits the anus and the private parts in a smaller area with a greater force per unit area, the first jetting water contributes to producing the pungent feeling of the wash feeling on the anus and the private parts. Since the second jetting water hits the anus and the private parts in a larger area with a smaller force per unit area, the second jetting water contributes to producing the enough feeling of the wash feeling. The first jetting water and the second jetting water alternately occur at peaks of the pulsation of the water. Therefore, the time interval of jetting of the first jetting water and the second jetting water is constant, and the difference in speed between the first jetting water and the second jetting water at the time of jetting is small, so that the first jetting water and the second jetting water hit the anus and the private parts at uniform time intervals. As a result, the pungent feeling and the enough feeling can be alternately produced on the anus and the private parts at regular time intervals, and the uncomfortable feeling and the intermittent feeling caused by the water hitting the anus and the private parts at nonuniform time intervals can be suppressed. In addition, since the wash feeling is produced by using the first jetting water and the second jetting water that occur at the peaks of the pulsation, the pungent feeling and the enough feeling during washing are more intense than those in the case where a fixed amount of water jets at a fixed pressure. In other words, the same wash feeling can be achieved with a reduced amount of water.

Note that the phrase "alternately occur" used in the above description does not exclusively mean that a mass of first jetting water and a mass of second jetting water alternately occur at every other peaks of the pulsation of the water. For example, two successive masses of first jetting water and two successive masses of second jetting water may alternately occur at the peaks of the pulsation of the water. Furthermore, the phrase "alternately occur" may mean that two successive masses of first jetting water and a single mass of second jetting water alternately occur at the peaks of the pulsation of the water.

The sanitary washing apparatus according to the present invention preferably further comprises an amplitude adjuster that adjusts an amplitude of the pulsation of the water jetting from said nozzle to be equal to or smaller than a predetermined value.

Since the amplitude of the pulsation of the water is smaller than the predetermined value, the difference in speed between two successive masses of jetting water can be reduced to fall within a certain range. Therefore, a mass of jetting water can be prevented from overtaking the preceding mass of jetting water to grow into a larger water ball. If excessively large water balls are formed, the interval between the water balls hitting the anus and the private parts increases to produce an intermittent wash feeling. However, the arrangement described above can prevent occurrence of such an intermittent wash feeling.

Note that the "predetermined value" described above can vary with the sanitary washing apparatus. For example, the predetermined value can be set based on the distance between the jetting water outlet and the anus and the private parts to be washed or the maximum and minimum speeds of the jetting water, for example.

Preferably, the sanitary washing apparatus according to the present invention further comprises a water feed pipe that receives supply of water from an external water supply source, and a minimum value of the pressure of the water jetting from said jetting water outlet is higher than a pressure of feed water from said water supply source.

Since the minimum value of the pressure of the water is higher than the pressure of the feed water from the external water supply source, the jetting water generally does not have a low speed, so that variations of the speed of the jetting water can be suppressed. As a result, even jetting water having a relatively low speed can reach the anus and the private parts without being overtaken by the following jetting water having a relatively high speed. Therefore, the jetting water can be prevented from being overtaken by the following jetting water to grow into a larger water ball, and the interval between hits by the jetting water can be prevented from increasing. Therefore, the intermittent wash feeling on the anus and the private parts can be prevented from occurring.

Preferably, in the sanitary washing apparatus according to the present invention, said flowing water adjuster comprises: a flow path for feeding pulsating water to said jetting water outlet; and an air mixer that is connected to said flow path and mixes air with the water flowing through the flow path, and said air mixer mixes air with said water in such a manner that the pulsating water jetting from said nozzle includes jetting waters containing different amounts of air that alternately occur at peaks of the pulsation of the water jetting from said nozzle.

If a larger amount of air is mixed with the water, the apparent volume of the water increases in accordance with the volume of the mixed air. Therefore, the density of the jetting water decreases, and the cross-sectional area of the water perpendicular to the direction of jetting (the area of the water in a plane normal to the direction of jetting) increases. On the other hand, if a smaller amount of air is mixed with the water, the density of the jetting water increases, and the cross-sectional area of the water perpendicular to the direction of jetting decreases. According to the arrangement described above, if different amounts of air are alternately mixed with the water at the peaks of the pulsation of the water, the first jetting water and the second jetting water alternately occur at the peaks of the pulsation of the jetting water. That is, the flowing water adjuster can be simply composed of a single flow path and a single air mixer.

In the sanitary washing apparatus according to the present invention, said flowing water adjuster preferably comprises: a first flow path for feeding first flowing water that pulsates by cyclically changing pressure to said jetting water outlet; and a second flow path for feeding second flowing water that pulsates by cyclically changing pressure to said jetting water outlet in opposite phase with said first flowing water. Said first flowing water jets from said jetting water outlet as said first jetting water, and said second flowing water jets from said jetting water outlet as said second jetting water. Said first jetting water jetting from said jetting water outlet has a higher density and a smaller cross-sectional area perpendicular to a direction of jetting than said second jetting water. Said second jetting water jetting from said jetting water outlet has a lower density and a larger cross-sectional area perpendicular to the direction of jetting than said first jetting water.

When flows of water having different flow speeds (flow rates) join, the flow of water having the higher flow speed (flow rate) dominates the resulting flow of water. According to the arrangement described above, since the first pulsating flowing water and the second pulsating flowing water in opposite phase with each other are fed to the jetting water outlet, the first flowing water and the second flowing water alternately dominate the jetting water. The first flowing water jets as the first jetting water having a higher density and a smaller cross-sectional area perpendicular to the direction of jetting than the second jetting water. The jetting water dominated by the first flowing water hits the anus and the private parts in a smaller area with a greater force per unit area and therefore contributes to producing the pungent feeling on the anus and the private parts. On the other hand, the second flowing water jets as the second jetting water having a lower density and a larger cross-sectional area perpendicular to the direction of jetting than the first jetting water. The jetting water dominated by the second flowing water hits the anus and the private parts in a larger area with a smaller force per unit area and therefore contributes to producing the enough feeling on the anus and the private parts.

Since the period in which the first flowing water dominates the jetting water and the period in which the second flowing water dominates the jetting water alternately occur in synchronization with the pulsation of the water, the pungent feeling and the enough feeling can be alternately produced on the anus and the private parts at regular time intervals. Therefore, the uncomfortable feeling and the intermittent feeling caused by the water hitting the anus and the private parts at nonuniform time intervals can be suppressed. In addition, since the jetting water is formed by combining the first flowing water and the second flowing water, the water can generally jet at a higher pressure. As a result, the pungent feeling and the enough feeling during washing can be more intense than those in the case where a fixed amount of water jets at a fixed pressure. In other words, the same wash feeling can be achieved with a reduced amount of water.

In addition, since the jetting water is formed by combining the first flowing water and the second flowing water, the amplitude of the pulsation of the jetting water is smaller than those of the first flowing water and the second flowing water. Therefore, the difference in speed between two successive masses of jetting water can be reduced to fall within a certain range. Therefore, a mass of jetting water can be prevented from overtaking the preceding mass of jetting water to grow into a larger water ball. If excessively large water balls are formed, the interval between the water balls hitting the anus and the private parts increases to produce an intermittent wash feeling. However, the arrangement described above can prevent occurrence of such an intermittent wash feeling.

In the sanitary washing apparatus according to the present invention, said flowing water adjuster preferably comprises an air mixer that is connected to said first flow path and said second flow path and mixes air with each of said first flowing water and said second flowing water. An amount of air mixed with said second flowing water at said jetting water outlet is preferably larger than an amount of air mixed with said first flowing water.

According to the arrangement described above, since the second flowing water at the jetting water outlet is mixed with a larger amount of air than the first flowing water, the second flowing water has a larger apparent volume than the first flowing water. Therefore, the second jetting water formed by the second flowing water can have a lower density and a larger cross-sectional area perpendicular to the direction of jetting than the first jetting water formed by the first flowing water by a simple measure of mixing different amounts of air with the water. The first flowing water may not be mixed with air (in other words, the amount of air mixed with the first flowing water may be 0).

Preferably, in the sanitary washing apparatus according to the present invention, said flowing water adjuster feeds said first flowing water and said second flowing water to said jetting water outlet by making said first flowing water and said second flowing water swirl, and a degree of swirling of said second flowing water at said jetting water outlet is higher than a degree of swirling of said first flowing water.

According to the arrangement described above, since the degree of swirling of the second flowing water at the jetting water outlet is higher than the degree of swirling of the first flowing water, the second jetting water formed by the second flowing water expands in the air in the direction perpendicular to the direction of jetting compared with the first jetting water formed by the first flowing water. Therefore, with a simple measure of varying the degree of swirling of the flows of water to the jetting water outlet, the second jetting water can have a higher density and a larger cross-sectional area perpendicular to the direction of jetting than the first jetting water.

Preferably, in the sanitary washing apparatus according to the present invention, said first flowing water at said jetting water outlet is a straight flow.

According to the arrangement described above, since the first flowing water is a straight flow, the first flowing water has a higher density and a smaller cross-sectional area than a swirling flow. Therefore, the jetting water dominated by the first flowing water can produce a more intense pungent feeling on the private area.

Preferably, in the sanitary washing apparatus according to the present invention, said flowing water adjuster comprises: a pump that cyclically pressurizes water to make the water pulsate; and a divider that distributes the water pulsated by said pump between said first flow path and said second flow path.

According to the arrangement described above, since the water pulsated by the pump is distributed between the first flow path and the second flow path, the first flowing water and the second flowing water can be cyclically pulsated with a single pump. Therefore, the sanitary washing apparatus can be reduced in size.

Preferably, in the sanitary washing apparatus according to the present invention, said first flow path and said second flow path have different flow path lengths to feed said second flowing water pulsating in opposite phase with said first flowing water to said jetting water outlet.

According to the arrangement described above, even when the water fed to the first flow path and the water fed to the second flow path pulsate in phase, the second flowing water can be made to pulsate in opposite phase with the first flowing water at the jetting water outlet by a simple measure of adjusting the flow path lengths of the first flow path and the second flow path.

Preferably, in the sanitary washing apparatus according to the present invention, said first flow path and said second flow path have different accumulation pressures to feed said second flowing water pulsating in opposite phase with said first flowing water to said jetting water outlet.

According to the arrangement described above, even when the water fed to the first flow path and the water fed to the second flow path pulsate in phase, the second flowing water can be made to pulsate in opposite phase with the first flowing water at the jetting water outlet by a simple measure of varying the pressure accumulation in the first flow path and the second flow path.

The present invention provides a sanitary washing apparatus that produces a comfortable wash feeling that combines an enough feeling and a pungent feeling with a small amount of water while reducing an uncomfortable feeling and an intermittent feeling caused by water nonuniformly hitting an anus and the private parts of a human body.

BRIEF DESCRIPTION OF THE DRAWINGS

FIG. 7 includes timing charts for illustrating conditions of pulsating water, in which FIG. 7(A) is a timing chart schematically showing a pressure variation of the pulsating water at the time of jetting, and FIG. 7(B) is a timing chart showing a flow rate variation of air contained in the pulsating water shown in FIG. 7(A);

FIG. 11 includes timing charts for illustrating conditions of pulsating water in the case where the modification of the nozzle tip end part shown in FIGS. 9 and 10 is adopted, in which FIG. 11(A) is a timing chart schematically showing a pressure variation of the pulsating water at the time of jetting, and FIG. 11(B) is a timing chart showing a flow rate variation of air contained in the pulsating water shown in FIG. 11(A).

DETAILED DESCRIPTION OF THE PREFERRED EMBODIMENTS

Figure 1:
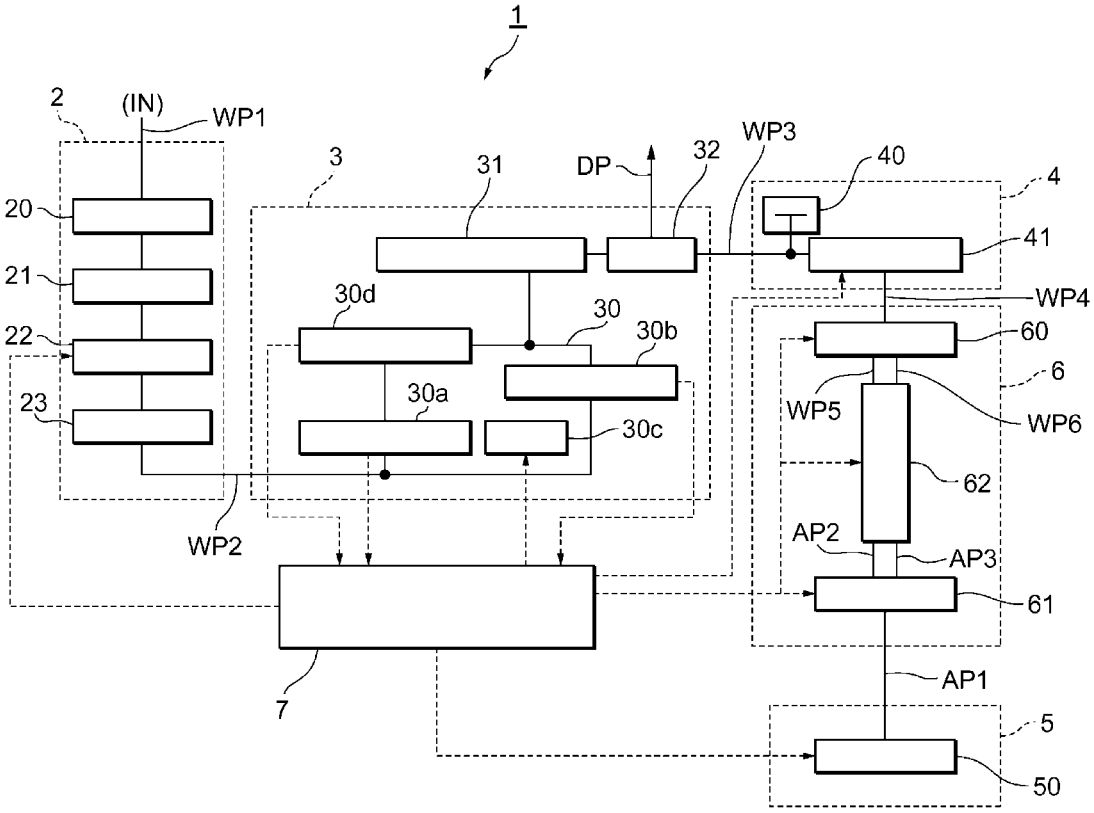
FIG. 1 is a schematic diagram showing a configuration of the whole of a sanitary washing apparatus.

In the following, embodiments of the present invention will be described with reference to the accompanying drawings. To help understanding of the description, the same components will be denoted by the same reference numerals throughout the drawings whenever possible, and redundant descriptions thereof will be omitted.

Referring to FIG. 1, a sanitary washing apparatus according to an embodiment of the present invention will be first described. FIG. 1 is a schematic diagram showing a configuration of the whole of a sanitary washing apparatus 1 according to an embodiment of the present invention. The sanitary washing apparatus 1 is a hot water washing system to be attached to a toilet seat and is used to wash an anus and the private parts of a human body, such as the anus.

The sanitary washing apparatus 1 comprises a water inlet valve unit 2, a heat exchanging unit 3, a pulsating unit 4, an air supply unit 5, a nozzle unit 6, and a controller 7.

Water is introduced into the water inlet valve unit 2 from an external water supply source (a water service pipe, for example) and heated by the heat exchanging unit 3. The resulting hot water is pulsated by the pulsating unit 4 and mixed with air by the air supply unit 5. The resulting pulsating hot water containing air is jetted toward an anus and the private parts of a human body (such as the anus and the genital area) from the nozzle unit 6. These units are housed in a casing of the sanitary washing apparatus 1 and connected to each other by a water feed pipe or an air feed pipe. The controller 7 is connected to the units by wire or wirelessly to control various operations of the units. In the following, the individual components will be described in detail.

A water feed pipe WP1 connected to the water supply source is connected to the water inlet valve unit 2. Viewed from the upstream side to the downstream side along the water feed pipe WP1, the water inlet valve unit 2 comprises a strainer 20, a check valve 21, an electromagnetic valve 22, and a pressure regulating valve 23. Water (tap water, for example) introduced from the water supply source through the water feed pipe WP1 is deprived of a contaminant or the like by the strainer 20 of the water inlet valve unit 2 and then flows into the check valve 21. Then, when the electromagnetic valve 22 is opened, the water flows into the pressure regulating valve 23, is regulated to achieve a predetermined pressure (a feed water pressure of 0.110 MPa, for example), and then flows into the heat exchanging unit 3 through a water feed pipe WP2. The heat exchanging unit 3 is of an instantaneous heating type. The flow rate of the pressure-regulated water flowing into the heat exchanging unit 3 is approximately 200 to 600 cc/min. Alternatively, the water feed pipe WP1 connected to the water inlet valve unit 2 may not be connected to the water supply source but connected to a water closet tank (not shown) which stores water for washing a toilet bowl.

Viewed from the upstream side to the downstream side along the water feed pipe WP2, the heat exchanging unit 3 comprises a heat exchanger 30, a vacuum breaker 31, and a safety valve 32. The heat exchanging unit 3 heats the water fed from the water inlet valve unit 2 through the water feed pipe WP2 to a predetermined preset temperature. The resulting hot water flows to the pulsating unit 4 through a water feed pipe WP3.

In the heat exchanger 30, an influent water temperature sensor 30*a* detects the temperature of the water flowing into the heat exchanger 30, and an effluent water temperature sensor 30*b* detects the temperature of the water flowing out of the heat exchanger 30. According to the detected temperatures, a heater 30*c* heats the water to a predetermined preset temperature. The controller 7 optimally controls the heater 30*c* by combining feed-forward control and feed-back control. The heat exchanger 30 further has a float switch 30*d* that detects the level of water in the heat exchanger 30. If the water level drops below a predetermined level and the heater 30*c* is no longer submerged in the water, the float switch 30*d* outputs a signal indicating that fact to the controller 7. When the controller 7 receives the signal, the controller 7 stops energization of the heater 30*c*. Therefore, it is possible to prevent the heater 30*c* that is not submerged in water from being energized and heating without water.

The vacuum breaker 31 is disposed at the point of connection between the outlet of the heat exchanger 30 and the water feed pipe WP3. The vacuum breaker 31 introduces air into the water feed pipe WP3 when the pressure in the water feed pipe WP3 is negative. This makes the water downstream of the heat exchanger 30 be discharged from the nozzle unit 6, thereby preventing the water in the water feed pipe WP3 downstream of the heat exchanger 30 from flowing back into the heat exchanger 30.

The safety valve 32 opens when the pressure of water in the water feed pipe WP3 exceeds a predetermined value. Once the safety valve 32 opens, water can be discharged to a water drain pipe DP, and damage to a device, detachment of a hose, or other problems occurring in abnormal situations can be prevented.

Viewed from the upstream side of the water feed pipe WP3, the pulsating unit 4 (a flowing water adjuster) comprises an accumulator 40 and a pulsator 41.

The accumulator 40 has a housing, a damper chamber in the housing, and a damper disposed in the damper chamber. In the accumulator 40, the damper serves to reduce a water hammer on the water feed pipe WP3 on the upstream side of the pulsator 41. Therefore, the effect of the water hammer on the temperature distribution of the water in the heat exchanger 30 can be reduced, and thus, the water temperature can be stabilized. The accumulator 40 is preferably disposed close to or in contact with the pulsator 41. If the accumulator 40 is disposed in this way, a pulsation produced by the pulsator 41 can be promptly and effectively prevented from propagating to the upstream side.

Figure 2:
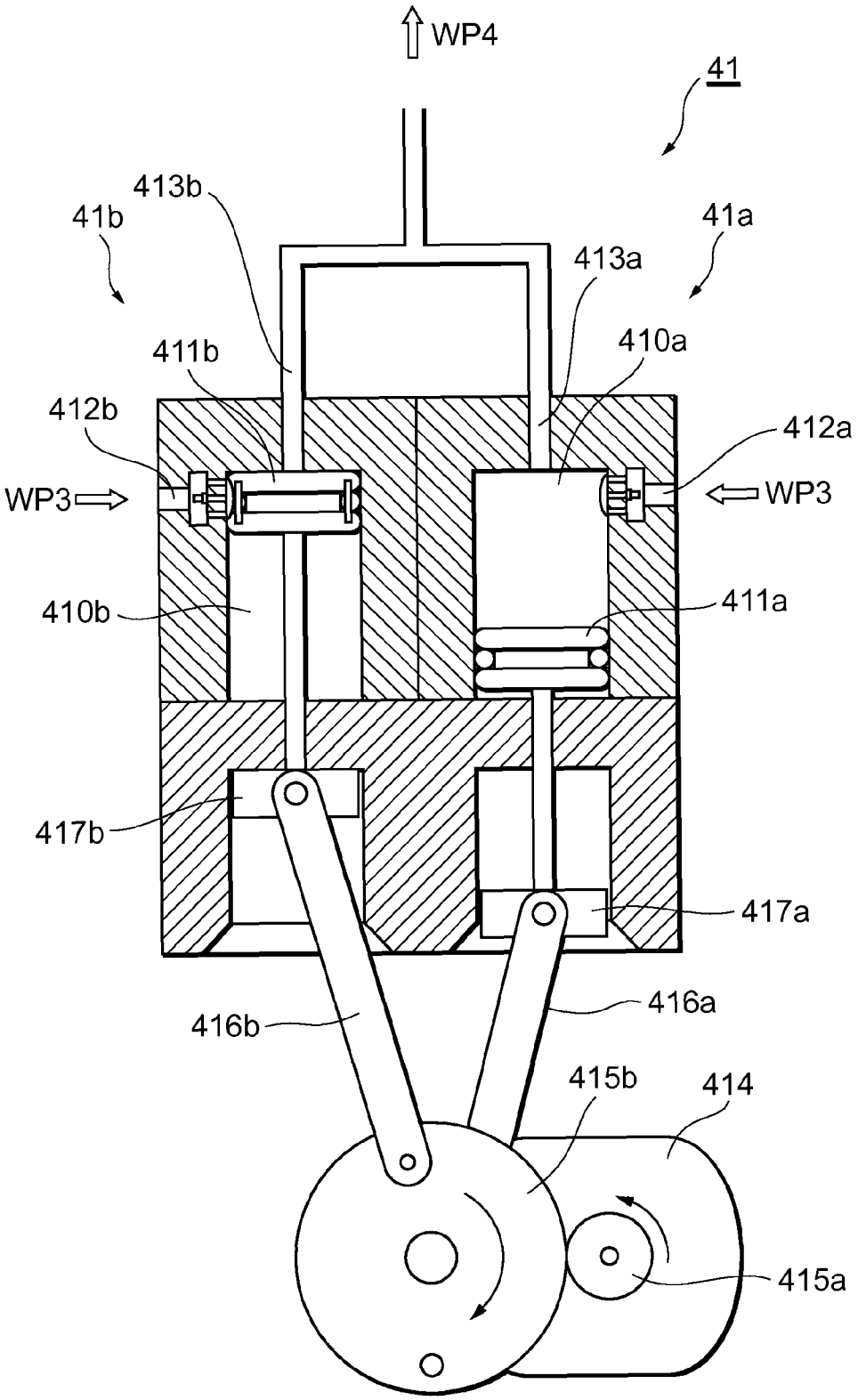
FIG. 2 is a schematic diagram showing a configuration of a pulsator of the sanitary washing apparatus.

The pulsator 41 is composed of a double reciprocating pump. The pulsator 41 will be described with reference to FIG. 2. FIG. 2 is a schematic diagram showing a configuration of the pulsator 41.

As shown in FIG. 2, the pulsator 41 is composed of a double reciprocating pump comprising a first pulsating part 41*a* and a second pulsating part 41*b*. The first pulsating part 41*a* and the second pulsating part 41*b* have a cylinder 410*a* and a cylinder 410*b* having a circular cylindrical cavity, respectively. Pistons 411*a* and 411*b* are disposed in the cylinders 410*a* and 410*b*, respectively. An O-ring is fitted on the pistons 411*a* and 411*b*. The space defined by the piston 411*a* and the cylinder 410*a* and the space defined by the piston 411*b* and the cylinder 410*b* serve as a pressurizing chamber.

The cylinder 410*a* has a wash water inlet 412*a*, and the cylinder 410*b* has a wash water inlet 412*b*. Pipes branched from the water feed pipe WP3 are connected to the wash water inlets 412*a* and 412*b* so that water can flows into the pressuring chamber from the water feed pipe WP3. The wash water inlets 412*a* and 412*b* are provided with an umbrella packing to prevent water from flowing back to the water feed pipe WP3. In addition, the cylinder 410*a* has a wash water outlet 413*a* formed in a ceiling part thereof, and the cylinder 410*b* has a wash water outlet 413*b* formed in a ceiling part thereof. Pipes are connected to the wash water outlets 413*a* and 413*b*, and the pipes are connected to a water feed pipe WP4 at a joint part. Therefore, the pressurized water flowing out of the cylinders 410*a* and 410*b* join and then flows into the water feed pipe WP4.

A gear 415*a* is attached to a rotation shaft of a motor 414 and is engaged with a gear 415*b*. A crank shaft 416*a* for moving the piston 411*a* of the first pulsating part 41*a* and a crank shaft 416*b* for moving the piston 411*b* of the second pulsating part 41*b* are attached to the gear 415*b* at different positions. The crank shafts 416*a* and 416*b* are attached to the pistons 411*a* and 411*b* via piston holders 417*a* and 417*b*, respectively.

In this embodiment, the crank shafts 416*a* and 416*b* are attached to the gear 415*b* at such positions that when one of the pistons moves from the bottom dead center (original position) to the top dead center to minimize the volume of the pressurizing chamber, the other piston moves back to the bottom dead center (original position) from the top dead center to maximize the volume of the pressurizing chamber. Specifically, the crank shafts 416*a* and 416*b* are attached to the gear 415*b* at positions at the same distance from the center of the gear 415*b* and 180 degrees opposite to each other.

Figure 3:
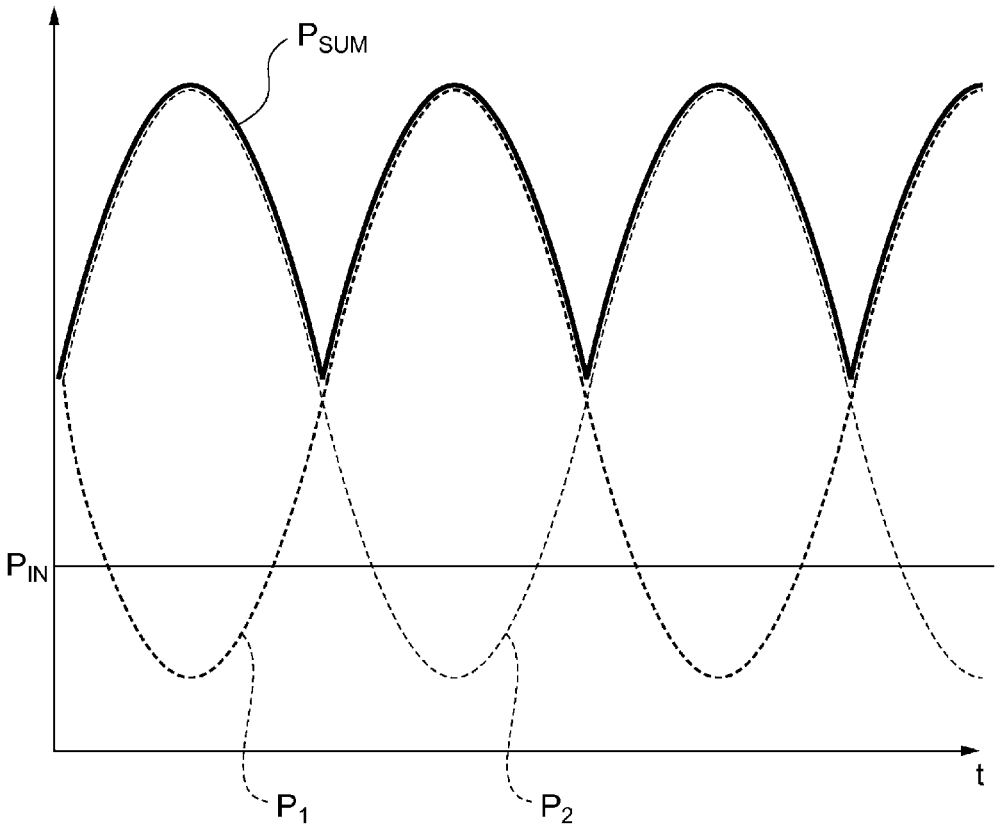
FIG. 3 is a timing chart schematically showing a pressure variation of water fed from the pulsator.

When the motor 414 is energized in response to a command from the controller 7, the rotation shaft rotates, and the pistons 411*a* and 411*b* reciprocate out of phase by 180 degrees. More specifically, when the piston 411*a* moves from the bottom dead center (original position) to the top dead center and pressurizes water to force the water to flow toward the water feed pipe WP4, the piston 411*b* moves back to the bottom dead center (original position) from the top dead center (at this time, the umbrella packing opens, and water flows into the cylinder 410*b*). As far as the motor 414 is rotating, this process and the reverse process alternately occur. As a result, the water fed to the water feed pipe WP4 cyclically changes pressure, or in other words, pulsates. FIG. 3 shows the pulsation. FIG. 3 is a timing chart schematically showing a pressure variation of the water fed from the pulsator 41.

As shown in FIG. 3, the pressure $P_{SUM}$ of the water fed from the pulsator 41 to the water feed pipe WP4 pulsates or, in other words, rises and falls with a certain period. The pressure $P_{SUM}$ is a synthesis pressure of the pressure $P_1$ of the water fed from the first pulsating part 41*a* and the pressure $P_2$ of the water fed from the second pulsating part 41*b* based on the fact that the water having the higher pressure dominates the jetting water. Even at a point where the water pressure is at a minimum (a valley of the pulsation), the water pressure is higher than the feed water pressure $P_{IN}$ of the water fed from the external water supply source. In addition, the difference between the minimum value and the maximum value (at a peak of the pulsation) of the water pressure is small and equal to or smaller than a predetermined value. That is, the pulsator 41 functions as an amplitude adjuster according to the present invention.

The pulsator 41 that causes water to pulsate and raises the minimum value of the pulsating water pressure beyond the feed water pressure is not limited to the double reciprocating pump described above. For example, the pulsator 41 may be a combination of a booster pump that continuously applies a constant pressure, such as a gear pump and a centrifugal pump, and a reciprocating pump, such as a single-acting pump and an electromagnetic pump. Alternatively, if the feed water pressure is high, the pulsator 41 may be composed only of a reciprocating pump, such as a single reciprocating pump and an electromagnetic pump.

Referring back to FIG. 1, the air supply unit 5 (flowing water adjuster, air mixer) comprises an air pump 50. The air pump 50 pressurizes air taken in from the outside and feeds the resulting pressurized air to an air feed pipe AP1 according to a command from the controller 7. As described later, the air pump 50 adjusts the amount of jetted air and the timing of jetting of air in synchronization with the pulsation of the water according to the command from the controller 7. The air pump 50 may be an electromagnetic turbopump that can be directly controlled by inputting a pulse signal to achieve a desired amount of jetted water and a desired timing of jetting.

The nozzle unit 6 (flowing water adjuster) comprises a water flow switch valve 60, an air flow switch valve 61 (air mixer), and a washing nozzle 62. The nozzle unit 6 is configured to jet the pulsating water to the anus or the genital area from a jetting water hole (a jetting water outlet) for butt washing or a jetting water hole (a jetting water outlet) for bidet washing according to a command from the controller 7. The water flow switch valve 60, the air flow switch valve 61 and the washing nozzle 62 are housed in one casing.

The water flow switch valve 60 is a disk-shaped switch valve electromagnetically driven, for example, and is disposed between the water feed pipe WP4 and water feed pipes WP5 and WP6. According to a command from the controller 7, the water flow switch valve 60 opens one of the pipes connecting to the water feed pipes WP5 and WP6 to switch the destination of the water fed from the pulsator 41 between the water feed pipes WP5 and WP6. At the same time, the water flow switch valve 60 adjusts the opening area of the joint to the water feed pipe WP5 or WP6 to adjust the flow rate. That is, the water flow switch valve 60 functions also as a flow rate adjustment valve.

The air flow switch valve 61 is a disk-shaped switch valve electromagnetically driven, for example, and is disposed between the air feed pipe AP1 and air feed pipes AP2 and AP3. According to a command from the controller 7, the air flow switch valve 61 opens one of the pipes connecting to the air feed pipes AP2 and AP3 to switch the destination of the air fed from the air pump 50 between the air feed pipes AP2 and AP3.

Figure 4:
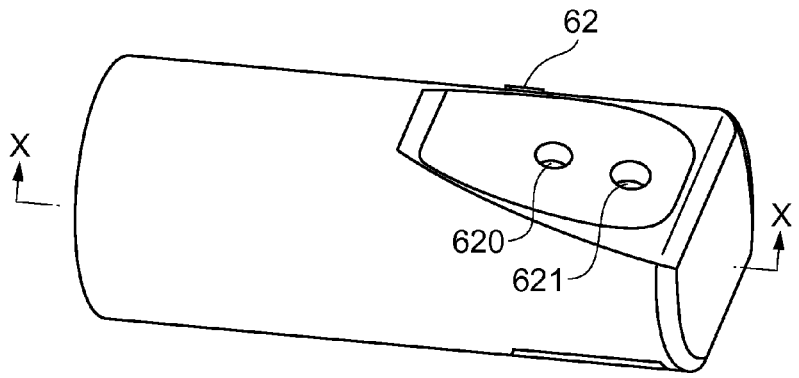
FIG. 4 is a perspective view showing a schematic configuration of a tip end part of a nozzle.
Figure 5:
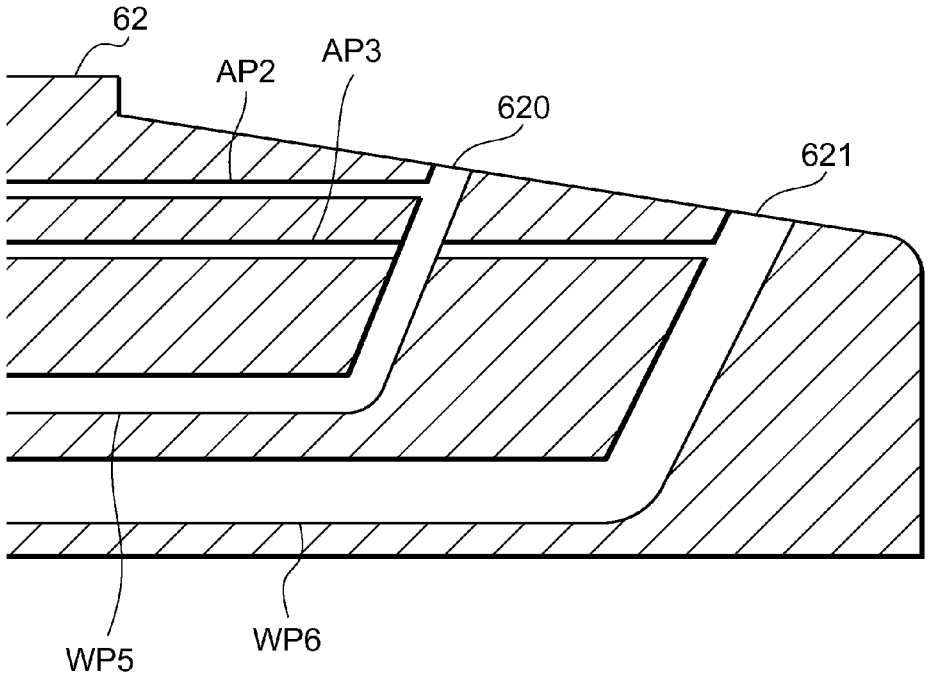
FIG. 5 is a schematic cross-sectional view of the tip end part of the nozzle shown in FIG. 4 taken along the line X-X.

The nozzle 62 is driven by a nozzle driving motor (not shown) to move from a standby position in the sanitary washing apparatus 1 to a position below the anus or genital area to be washed. FIGS. 4 and 5 show a tip end part of the nozzle 62. FIG. 4 is a perspective view showing a schematic configuration of the tip end part of the nozzle, and FIG. 5 is a schematic cross-sectional view of the tip end part of the nozzle shown in FIG. 4 taken along the line X-X. As shown in FIGS. 4 and 5, the nozzle 62 has a jetting water hole 620 for butt washing and a jetting water hole 621 for bidet washing at positions close to the tip end thereof. The jetting water hole 621 for bidet washing is closer to the tip end than the jetting water hole 620 for butt washing.

As shown in FIG. 5, the jetting water hole 620 for butt washing is in communication with the water feed pipe WP5. The air feed pipe AP2 is connected to the water feed pipe WP5 at a position close to the jetting water hole 620 so that air is forcedly mixed with the water before the water reaches the jetting water hole 620 (the timing of air mixing will be described in detail later). On the other hand, the jetting water hole 621 for bidet washing is in communication with the water feed pipe WP6. The air feed pipe AP3 is connected to the water feed pipe WP6 at a position close to the jetting water hole 621 so that air is forcedly mixed with the water before the water reaches the jetting water hole 621 (the timing of air mixing will be described in detail later). In order to ensure that the impact of the water for bidet washing is weaker than the impact of the water for butt washing, the water feed pipe WP6 has a larger diameter than the water feed pipe WP5. As a result, the speed of the water jetting from the jetting water hole 621 is lower than the speed of the water jetting from the jetting water hole 620.

In response to input signals from various sensors provided in the sanitary washing apparatus 1 or user manipulations of wash buttons or the like, the controller 7 controls start and stop of water supply from the water supply source, heating of the water, pulsation of the water, switching of the path of the water, adjustment of the flow rate of the water, forward and backward movement of the nozzle, and start and stop of water jetting, for example.

Figure 6:
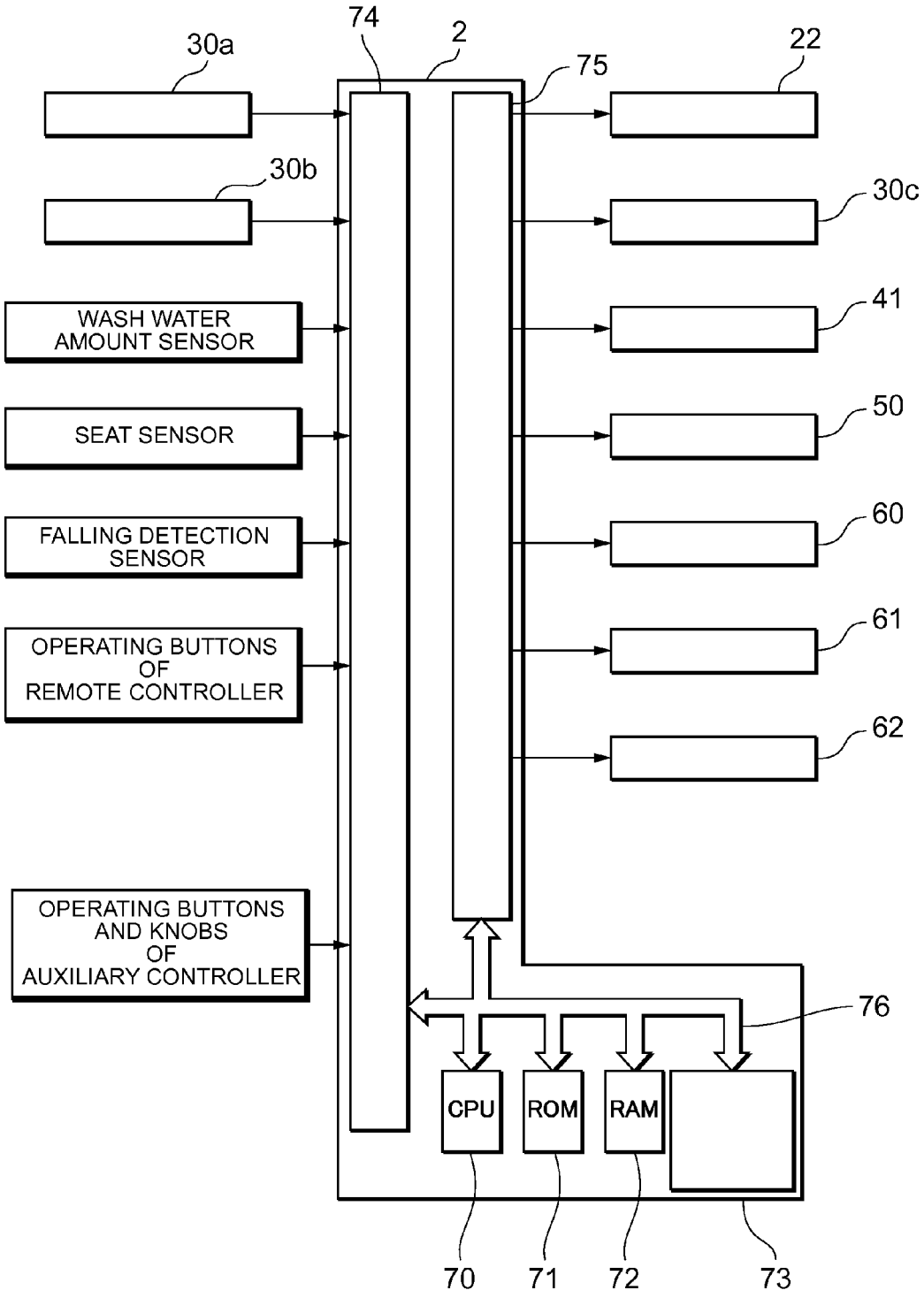
FIG. 6 is a block diagram showing a schematic configuration of a controller of the sanitary washing apparatus.

A specific configuration of the controller 7 will be described with reference to FIG. 6. FIG. 6 is a block diagram showing the controller 7. As shown in FIG. 6, the controller 7 comprises a CPU 70, a ROM 71 that stores a control program or control data processed by the CPU 70, a RAM 72 and a back-up RAM 73 primarily used as a work area for a control processing, an input processing circuit 74, and an output processing circuit 75. These components are connected to each other by a bus 76. The controller 7 receives, at the input processing circuit 74 by wire or wirelessly (via an optical signal, for example), not only signals from the influent water temperature sensor 30*a*, the effluent water temperature sensor 30*b* or other various sensors (a wash water meter, a seat sensor, a falling detection sensor and the like) but also signals indicating manipulations of various operation buttons or knobs including a wash button or the like of a remote controller.

According to the input signal described above, the CPU 70 performs various control operations including control of opening and closing of the electromagnetic valve 22 of the water inlet valve unit 2, control of energization of the heater 30*c* of the heat exchanging unit 3, control of rotation of the motor of the pulsator 41, control of jetting of air by the air pump 50, control of opening and closing of the water flow switch valve 60 and the air flow switch valve 61, control of driving of the nozzle 62, and the like. Other control operations include control of indication on a main unit display, control of energization of a dryer for drying the anus and the private parts of the human body including a drying heater and a fan motor, control of energization of a deodorizing part for odor elimination including an ozonizer and a suction fan motor, and control of energization of a heating part for room heating including a heater and a fan motor.

Figure 7:
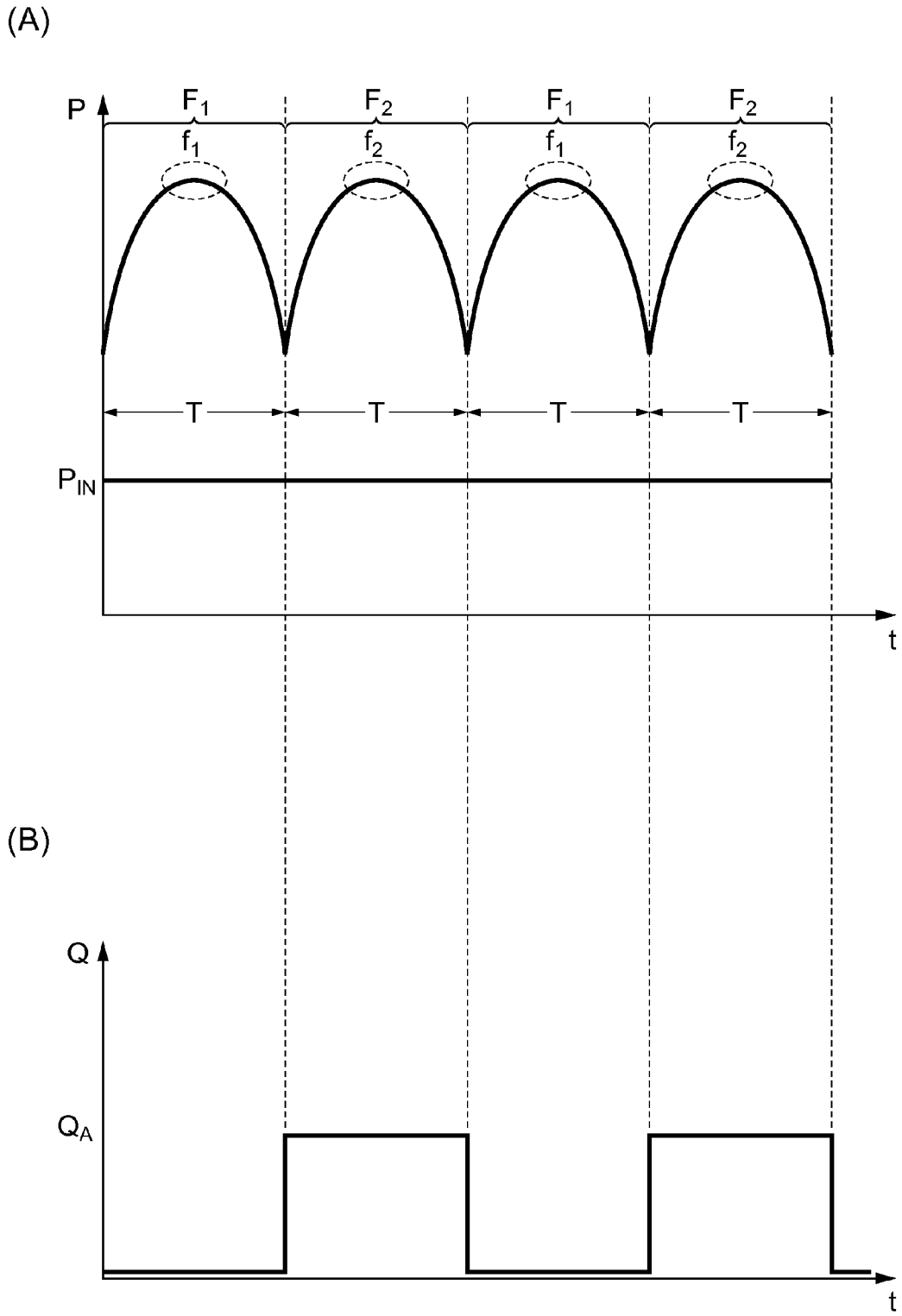
Figure 8:
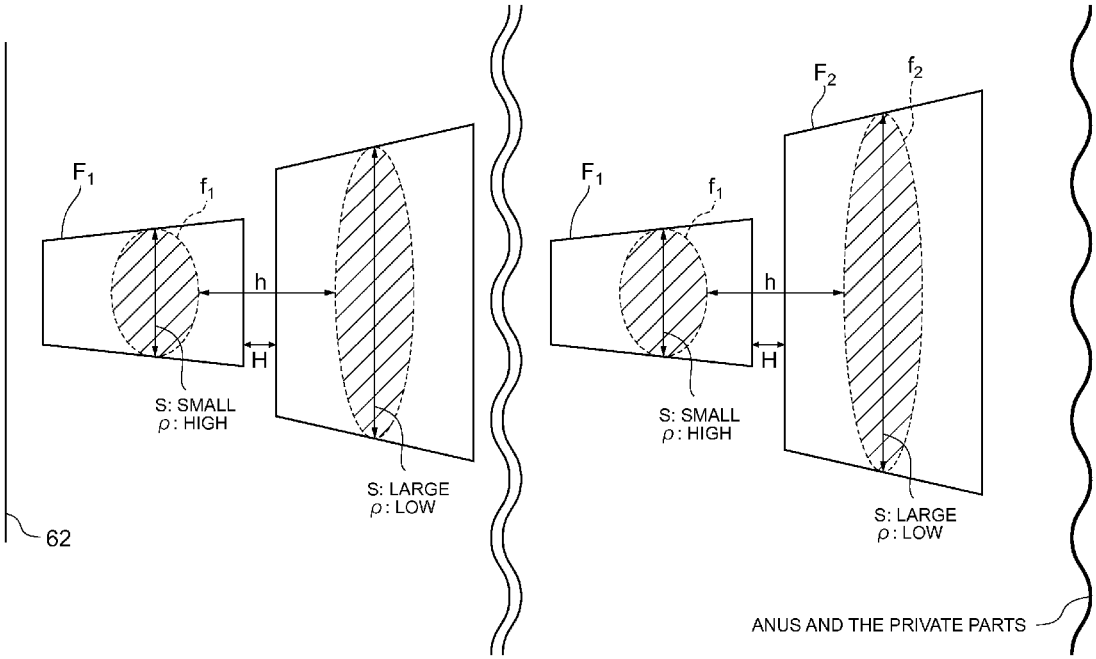
FIG. 8 is a schematic diagram showing water jetting from the nozzle.

According to this embodiment, the controller 7 controls the timing of supply of air from the air pump 50 and the amount of air supplied from the air pump 50, thereby producing a cyclic density variation in the water jetting from the nozzle 62. This operation will be described in detail below with reference to FIG. 7. FIG. 7(A) is a timing chart schematically showing a pressure variation of the pulsating water at the time of jetting, and FIG. 7(B) is a timing chart showing a flow rate variation of the air contained in the pulsating water shown in FIG. 7(A). FIG. 8 is a schematic diagram showing the water jetting from the nozzle.

The controller 7 controls the amount of the pressurized air supplied from the air pump 50 and the timing of supply of the pressurized air from the air pump 50 so that the amount of air mixed with the jetting water is different for every two periods of the pulsation of the water. More specifically, the controller 7 controls the amount of the pressurized air supplied from the air pump 50 and the timing of supply of the pressurized air from the air pump 50 so that the amount of air mixed with the jetting water alternately changes between 0 and a predetermined amount ($Q_A$) each time a period (T) of the pulsation elapses as shown in FIG. 7(B). As a result of the variation of the amount of the mixed air, the water jetting from the nozzle 62 to the anus and the private parts of the human body includes a jetting water mass $F_1$ and a jetting water mass $F_2$ having different characteristics that alternately occur for the period of the pulsation of the water as shown in FIGS. 7(*a*) and 8. In FIG. 8, for the clarity of illustration of the difference between the masses of jetting water F1 and $F_2$, an amount of water jetting at a certain instance (jetting water $f_1$, $f_2$, and the like) is shown as a group, and the group is referred to as a jetting water mass $F_1$ or $F_2$. However, the jetting water is actually composed of small individual water droplets and does not form a large jetting water mass $F_1$ or $F_2$.

The jetting water mass $F_1$ is an amount of jetting water that is not mixed with air from the air pump 50. In the jetting water mass $F_1$, jetting water $f_1$ (first jetting water) jetting at a peak of the pulsation has a maximum jetting speed and a maximum flow rate and therefore predominantly produces the wash feeling (the pungent feeling) when hitting the anus and the private parts of the human body. Since the jetting water forming the jetting water mass $F_1$ does not contain air, the jetting water has a smaller apparent volume than the jetting water forming the jetting water mass $F_2$ and, as a result, forms "dense jetting water" having a high density (ρ) and a small cross-sectional area (S) perpendicular to the jetting direction. The "dense jetting water" hits the anus and the private parts in a narrow range (area) while having a high impact per unit area, so that the "dense jetting water" contributes to producing the pungent feeling of the wash feeling on the anus and the private parts.

The jetting water mass $F_2$ is an amount of jetting water that is mixed with air from the air pump 50. In the jetting water mass $F_2$, jetting water $f_2$ (second jetting water) jetting at a peak of the pulsation has a maximum jetting speed and a maximum flow rate and therefore predominantly produces the wash feeling (the enough feeling) when hitting the anus and the private parts. Since the jetting water forming the jetting water mass $F_2$ contains air, the jetting water has a greater apparent volume than the jetting water forming the jetting water mass $F_1$ and, as a result, forms "sparse jetting water" having a low density (ρ) and a large cross-sectional area (S) perpendicular to the jetting direction. The "sparse jetting water" hits the anus and the private parts in a wide range (area) while having a low impact per unit area, so that the "sparse jetting water" contributes to producing the enough feeling of the wash feeling on the anus and the private parts.

As shown in FIG. 8, since the period of the pulsation is constant (T), and the average jetting speed does not vary over the periods, the distance between the jetting water mass $F_1$ and the jetting water mass $F_2$ is substantially kept constant (H) until the water reaches the anus and the private parts. Therefore, the "sparse jetting water" and the "dense jetting water" alternately hit the anus and the private parts at substantially regular intervals. In a case where a reduced amount of water is used, the jetting water $f_1$, $f_2$ having the maximum speed and the maximum flow rate in each jetting water mass is particularly perceptible. The distance between the jetting water $f_1$ and the jetting water $f_2$ is kept at a substantially constant distance h until the water reaches the anus and the private parts. The timing of jetting of the jetting water $f_1$ and $f_2$ is always at a peak of the pulsation, and the jetting water $f_1$ and $f_2$ has the same, maximum jetting speed. In other words, the interval between the jetting water $f_1$ and the jetting water $f_2$ hitting the anus and the private parts is also uniform. That is, the water hitting the anus and the private parts of the human body according to this embodiment is composed of the jetting water mass $F_1$ and the jetting water mass $F_2$ (or the jetting water $f_1$ and the jetting water $f_2$) alternately hitting the anus and the private parts at regular intervals and therefore can alternately produces the enough feeling and the pungent feeling on the anus and the private parts of the human body at regular intervals.

According to this embodiment, as described above, the water fed from the pulsator 41 has a maximum jetting pressure sufficiently higher than the feed water pressure $P_{IN}$ and a pulsation amplitude reduced to equal to or smaller than a predetermined value. Therefore, the water is jetted at such a speed as to produce a sufficient impact, and the difference in speed between the jetting waters is small. Therefore, a so-called "overtaking phenomenon" of the jetting water forming the jetting water mass $F_1(F_2)$ (a phenomenon in which jetting water overtakes the preceding jetting water to grow into a larger water ball) is prevented. If the overtaking phenomenon occurs, the interval between the water balls hitting the anus and the private parts increases to produce an intermittent wash feeling. However, according to this embodiment, such an overtaking phenomenon is prevented, and therefore, the intermittent wash feeling can be prevented.

Although an embodiment of the present invention has been described above, the present invention is not limited to this embodiment, and various other embodiments are possible without departing from the scope and spirit of the present invention.

In the embodiment described above, the controller 7 controls the amount of air mixed with the jetting water to be different for every two periods of the pulsation. However, the present invention is not limited to this implementation. For example, the amount of air mixed with the jetting water may be different for every three periods of the pulsation. More specifically, the jetting water may include two successive jetting water masses $F_1$ and two successive jetting water masses $F_2$ occurring alternately. Alternatively, for example, the air from the air pump 50 may be mixed with the jetting water once every three periods of the pulsation so that the jetting water include two successive jetting water masses $F_1$ and one jetting water mass $F_2$ occurring alternately. Alternatively, for example, the amount of air mixed with the jetting water at a peak of the pulsation in order to predominantly produce the wash feeling on the anus and the private parts of the human body may be alternately changed. In these ways, the frequency of occurrence of the dense part and the sparse part of the jetting water can be changed to appropriately adjust the enough feeling and the pungent feeling to suit the user's preference.

In the embodiment described above, the water feed pipe WP5 (WP6) has a constant diameter, and the water jetting from the nozzle 60 forms a straight flow that contains little swirl component. However, the present invention is not limited to this embodiment. For example, the water feed pipe WP5(WP6) may be provided with a swirl chamber to provide the water with a swirl component. In this case, a reduced pungent feeling can be produced on the anus and the private parts while maintaining a sufficient enough feeling.

Figure 9:
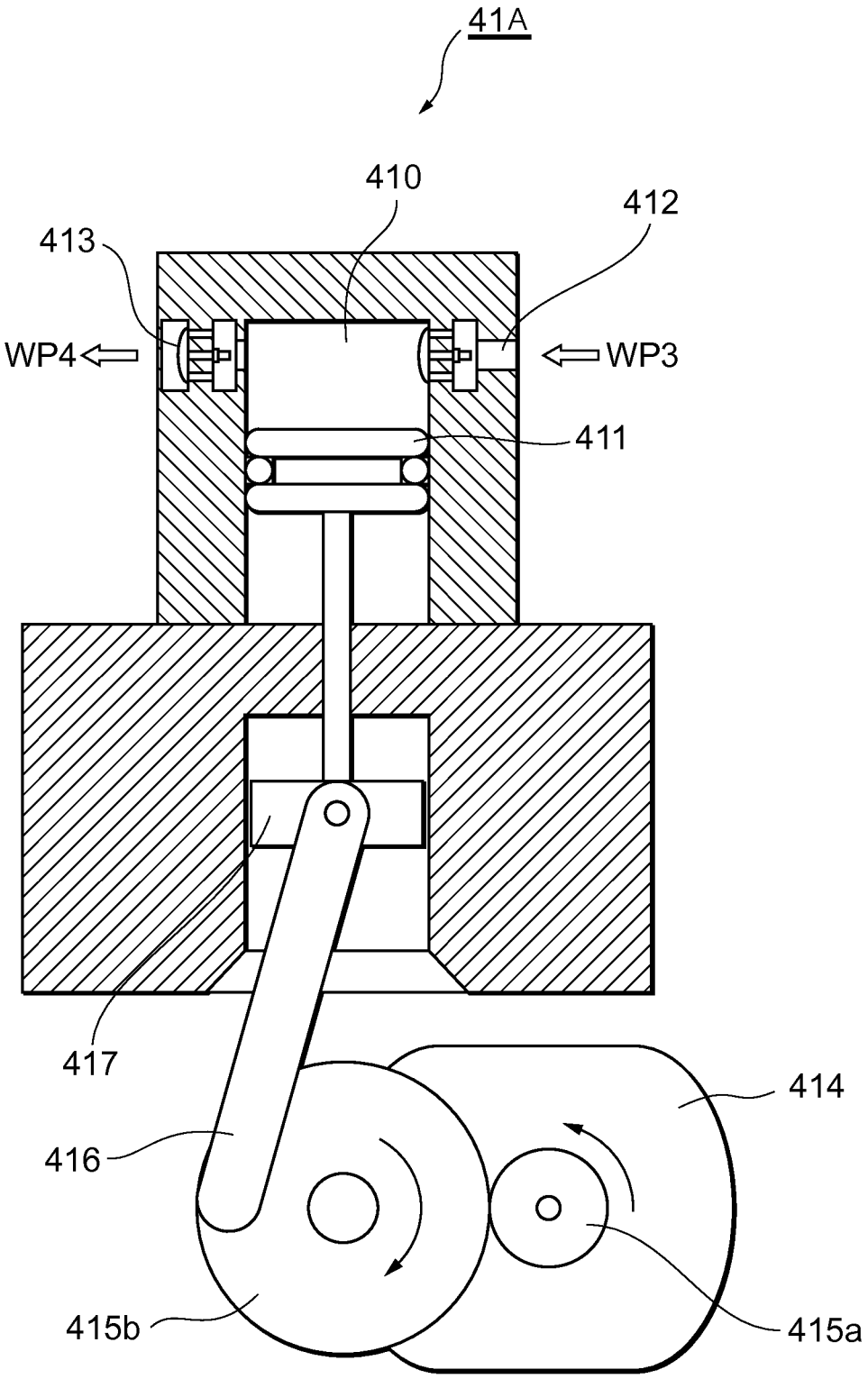
FIG. 9 is a schematic diagram showing a configuration of a modification of the pulsator shown in FIG. 2.

In the embodiment described above, the pulsator 41 is composed of a double reciprocating pump. However, the pulsator 41 may be composed of a single reciprocating pump. This implementation will be described with reference to FIG. 9. FIG. 9 is a diagram showing a schematic configuration of a pulsator 41A composed of a single reciprocating pump.

As shown in FIG. 9, the pulsator 41A has a cylinder 410 having a circular cylindrical cavity. A piston 411 is disposed in the cylinder 410. An O-ring is fitted on the piston 411. The space defined by the piston 411 and the cylinder 410 serves as a pressurizing chamber. The cylinder 410 has a wash water inlet 412 formed in the side wall thereof. The water feed pipe WP3 is connected to the wash water inlet 412 so that water can flow into the pressuring chamber. The wash water inlet 412 is provided with an umbrella packing to prevent water from flowing back to the water feed pipe WP3. In addition, the cylinder 410 has a wash water outlet 413 formed in the side wall thereof at a position opposite to the wash water inlet 412. The water feed pipe WP4 is connected to the wash water outlet 413, and the water pressurized in the cylinder 410 is discharged into the water feed pipe WP4 through the wash water outlet 413.

A gear 415*a* is attached to a rotation shaft of a motor 414 and is engaged with a gear 415*b*. A crank shaft 416 for moving the piston 411 is attached to the gear 415*b*. The crank shaft 416 is attached to the piston 411 via a piston holder 417.

When the motor 414 is energized in response to a command from the controller 7, the rotation shaft rotates, and the piston 411 vertically reciprocates. More specifically, the piston 411 repeatedly performs a movement from the bottom dead center (original position) to the top dead center to pressurize the water and push the water into the water feed pipe WP4 and a movement back to the bottom dead center (original position) from the top dead center to introduce water into the cylinder 410. In this way, the wash water fed to the water feed pipe WP4 cyclically changes pressure, or in other words, pulsates.

Figure 10:
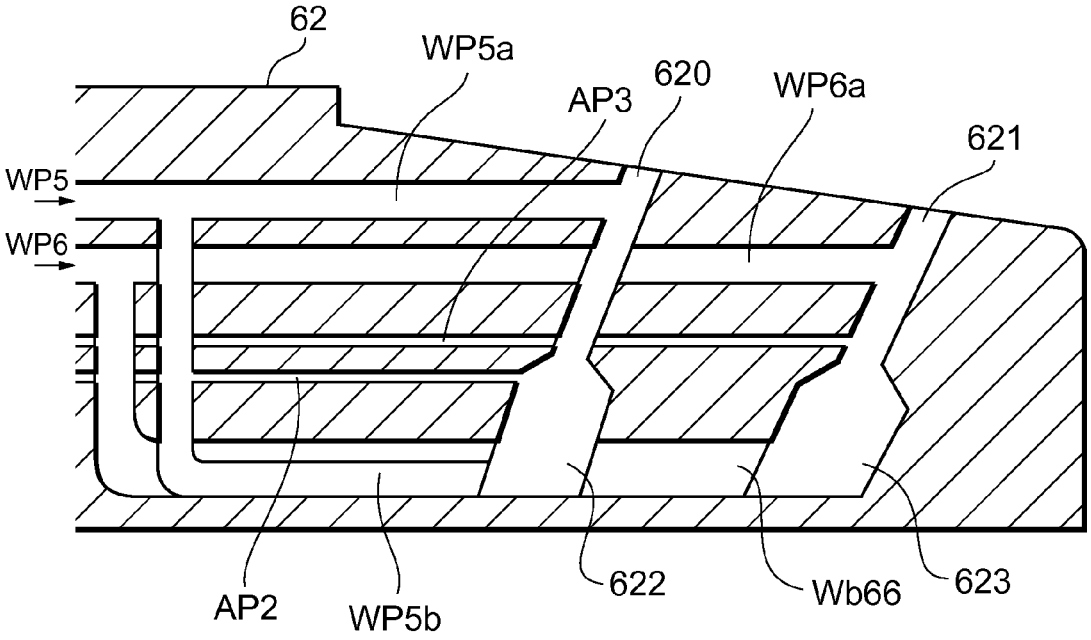
FIG. 10 is a schematic cross-sectional view of a tip end part of a modification of the nozzle shown in FIG. 5.

In the embodiment described above, a single flow path is provided for each of the jetting water holes 620 and 621 of the nozzle 62. However, two flow paths are preferably provided for each jetting water hole. An example in which two flow paths are provided for each of the jetting water holes 620 and 621 will be described below with reference to FIG. 10. FIG. 10 is a schematic cross-sectional view of the tip end part of the nozzle shown in FIG. 4 taken along the line X-X.

As shown in FIG. 10, the water feed pipe WP5 branches into a water feed pipe WP5*a* (a first flow path) and a water feed pipe WP5*b* (a second flow path). The water feed pipes WP5*a* and WP5*b* have the same diameter. The pulsating wash water fed from the water feed pipe WP5 to the water feed pipe WP5*a* and the pulsating wash water fed from the water feed pipe WP5 to the water feed pipe WP5*b* are in phase with each other and have the same flow rate.

The water feed pipe WP5*a* extends straight in the nozzle 62 and does not have a swirl chamber, which is provided in the water feed pipe WP5*b* as described later. Therefore, water (first flowing water) fed from the water feed pipe WP5*a* to the jetting water hole 620 forms a straight flow having a low degree of swirling.

The water feed pipe WP5*b* has a swirl chamber 622 having a substantially circular cylindrical hollow chamber. The upstream part of the water feed pipe WP5*b* is eccentrically connected to the bottom of the swirl chamber 622. Water fed into the swirl chamber 622 swirls along the inner wall of the swirl chamber 622.

The air feed pipe AP2 is connected to the swirl chamber 622 at a position close to a ceiling part of the swirl chamber 622 to forcedly mix air with the wash water. The controller 7 controls the timing of supply of air from the air pump 50 and the flow rate of the air supplied from the air pump 50 so that a predetermined amount ($Q_A$) of air is mixed with the pulsating wash water for a half of one period of the pulsation of the wash water including the peak of the pulsation. Therefore, the wash water fed from the ceiling part of the swirl chamber 622 into the downstream part of the water feed pipe WP5*b* forms a swirling flow that contains air for every half of the period of the pulsation including the peak of the pulsation.

The water feed pipe WP5*b* is designed to have a longer flow path length than the water feed pipe WP5*a*. More specifically, the water feed pipe WP5*b* is designed to have such a flow path length that the water fed to the jetting water hole 620 through the water feed pipe WP5*b* (the second flowing water) is in opposite phase with (or 180 degrees out of phase with) the water fed to the jetting water hole 620 through the water feed pipe WP5*a* (the first flowing water). In the design, a phase shifting caused by the swirling produced in the swirl chamber and forced mixing of air in the swirl chamber is also considered.

The water feed pipe WP5*a* and the water feed pipe WP5*b* are connected to each other at a position directly below and close to the jetting water hole 620 for butt washing. At this position, the straight flow having passed through the water feed pipe WP5*a* and the swirling flow having passed through the water feed pipe WP5*b* that are in opposite phase with each other join and jet through the jetting water hole 620.

Water feed pipes WP6*a* and WP6*b* in communication with the jetting water hole 621 for bidet washing and a swirl chamber 623 have basically the same configuration as the pipes in communication with the jetting water hole 620 for butt washing and the swirl chamber 622 described above, except that the water feed pipes WP6*a* and WP6*b* have larger diameters than the water feed pipes WP5*a* and WP5*b*. Therefore, the straight flow having passed through the water feed pipe WP6*a* and the swirling flow having passed through the water feed pipe WP6*b* that are in opposite phase with each other join and jet through the jetting water hole 621. The water feed pipes WP6*a* and WP6*b* are designed to have larger diameters than the water feed pipes WP5*a* and WP5*b* in order to reduce the speed of the water jetting from the jetting water hole 621 to below the speed of the water jetting from the jetting water hole 620. In this way, the impact of the wash water for bidet washing can be made weaker than the impact of the wash water for butt washing.

As described above with reference to FIG. 10, the water feed pipe WP5*a* (WP6*a*) and the water feed pipe WP5*b* (WP6*b*) are connected to each other at a position directly below and close to the jetting water hole 620 (621), and the straight flow having passed through the water feed pipe WP5*a* (WP6*a*) and the swirling flow having passed through the water feed pipe WP5*b* (WP6*b*) that are in opposite phase with each other join at this position and jet through the jetting water hole 620 (621). The swirling flow contains a predetermined amount ($Q_A$) of air for a half of the period of the pulsation including the peak of the pulsation. As a result, a cyclic density variation occurs in the wash water jetting from the jetting water hole 620 (621) of the nozzle 62.

Figure 11:
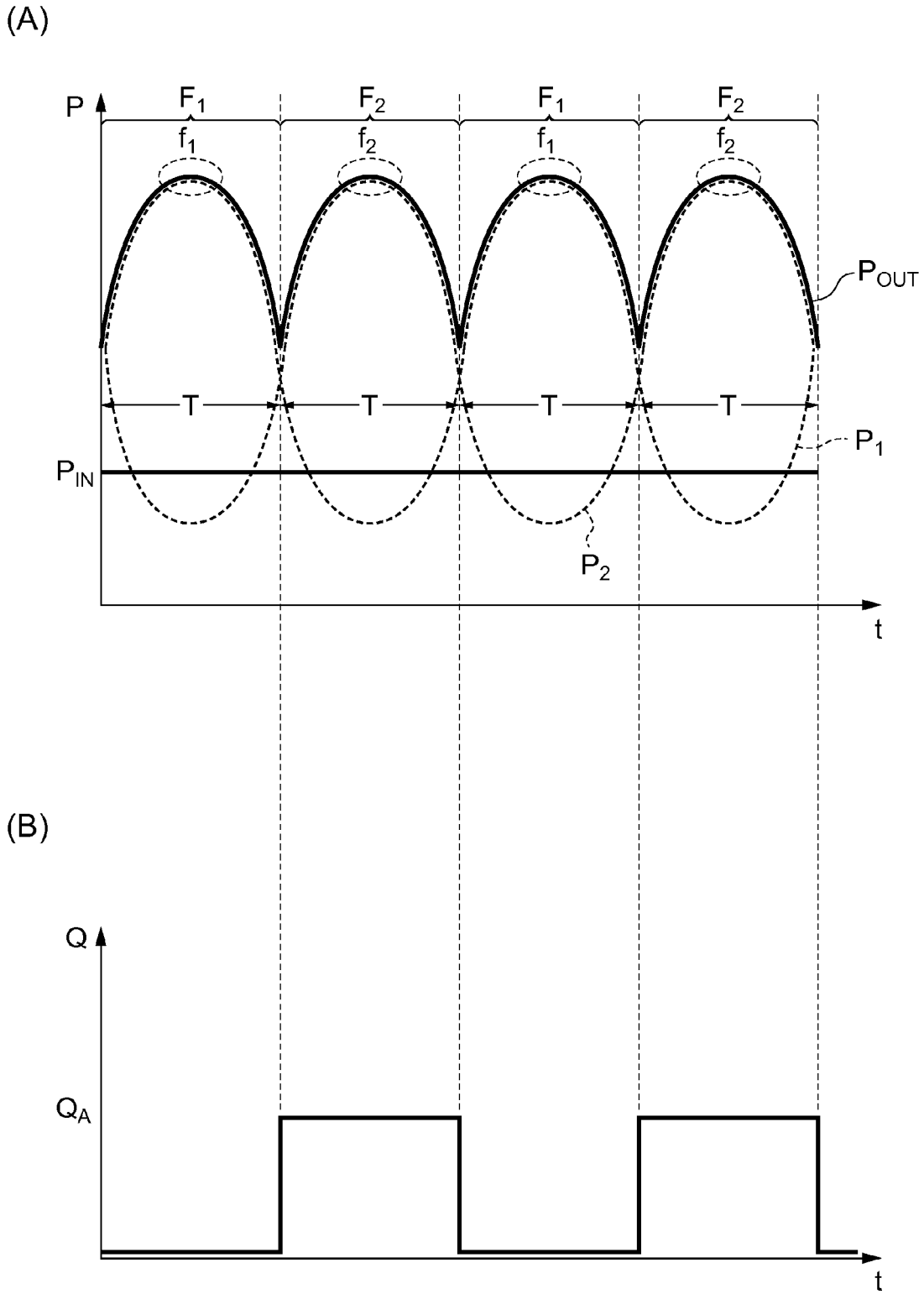

This will be described in detail with reference to FIG. 11 by taking the wash water jetting from the jetting water hole 620 as an example. FIG. 11(A) is a timing chart schematically showing a pressure variation of the pulsating water at the time of jetting, and FIG. 11(B) is a timing chart showing a flow rate variation of the air contained in the pulsating water shown in FIG. 11(A). The water jetting from the nozzle in this example is the same as that shown in FIG. 8 and therefore will be described with reference to FIG. 8.

As shown in FIG. 11(A), the straight flow from the water feed pipe WP5*a* and the swirling flow from the water feed pipe WP5*b* pulsate with the same period and are in opposite phase with each other. Therefore, the straight flow and the swirling flow alternately dominate the water jetting from the jetting water hole 620 with a certain period. As a result, as shown in FIGS. 11(A) and 8, the jetting water masses $F_1$ and $F_2$ having different characteristics alternately occur with the period of the pulsation. Since the swirling flow is mixed with the predetermined amount ($Q_A$) of air for a half of the period of the pulsation including the peak, the jetting water mass $F_2$ jetted while the swirling flow dominates the jetting water contains the predetermined amount ($Q_A$) of air, as shown in FIG. 11(B).

As shown in FIG. 11(A), the pressure $P_{OUT}$ of the jetting wash water is a synthesis pressure of the pressure $P_1$ of the straight flow fed from the water feed pipe WP5*a* and the pressure $P_2$ of the swirling flow fed from the water feed pipe WP5*b* based on the fact that the flow having the higher pressure dominates the jetting water. The maximum value of the pressure $P_{OUT}$ of the jetting water is sufficiently higher than the feed water pressure $P_{IN}$ of the water fed from the external water supply source. In addition, the amplitude of the pressure of the jetting water (the difference between the minimum value and the maximum value of the pressure $P_{OUT}$) is smaller than the amplitude of the pressure $P_1$ of the straight flow and the amplitude of the pressure $P_2$ of the swirling flow. Therefore, the so-called "overtaking phenomenon" of the jetting water forming the jetting water mass $F_1(F_2)$ (a phenomenon in which jetting water overtakes the preceding jetting water to grow into a larger water ball) is prevented. If the overtaking phenomenon occurs, the interval between the water balls hitting the anus and the private parts increases to produce an intermittent wash feeling. However, according to this example, such an overtaking phenomenon is prevented, and therefore, the intermittent wash feeling can be prevented.

In this example, the water feed pipes are designed to have such flow path lengths that the water flowing through the water feed pipes WP5*a* and WP5*b* (WP6*a* and WP6*b*) are in phase with each other when flowing into the pipes but are in opposite phase with each other when flowing out of the pipes. However, the measure to reverse the phase of the wash water fed to the jetting water hole 620 (621) is not limited thereto. For example, the flows of wash water fed to the outlets of the water feed pipes WP5*a* and WP5*b* (WP6*a* and WP6*b*) can be in opposite phase with each other because of different pressure accumulations in the pipes.

The pressure accumulation can be adjusted by providing an accumulator in the water feed pipe WP5*b* (WP6*b*) or making the water feed pipe WP5*b* (WP6*b*) of a material that is more elastic than the material of the water feed pipe WP5*a* (WP6*a*). Alternatively, the pressure accumulation can be adjusted by introducing air into the water feed pipe WP5*b* (WP6*b*) to produce the damper effect to increase the apparent elasticity of the water feed pipe WP5*b* (WP6*b*) compared with that of the water feed pipe WP5*a* (WP6*a*). As a further alternative, for example, the pressure accumulation can be adjusted by initially introducing water flows in opposite phase with each other into the water feed pipes WP5*a* and WP5*b* (WP6*a* and WP6*b*). For example, two pulsators 41*a* may be used to produce flows of water pulsating in opposite phases, and one of the pulsating water flows may be introduced into the water feed pipe WP5*a* (WP6*a*), and the other may be introduced into the water feed pipe WP5*b* (WP6*b*).

In this example, the jetting water masses $F_1$ and $F_2$ having different densities are formed by combining the straight flow and the swirling flow containing air. However, the present invention is not limited to this implementation as far as the jetting water masses $F_1$ and $F_2$ having different densities can be formed. For example, straight flows of water containing different amounts of air may be combined to form jetting water, or swirling flows of water having different degrees of swirling may be combined to form jetting water. In this way, the density of the jetting water can be varied, and the enough feeling and the pungent feeling can be appropriately adjusted to suit the user's preference.

In the embodiment described above, a hot water washing system used to wash the anus or the like has been described as an example. However, the present invention is not limited to the embodiment but can also be applied to a shower used to wash the anus and the private parts of a human body, for example.

What is claimed is:

1. A sanitary washing apparatus that jets water to an anus and the private parts of a user from a jetting water outlet of a nozzle, comprising:

the nozzle having the jetting water outlet from which water that pulsates by cyclically changing pressure jets; and a flowing water adjuster that adjusts flowing water fed to said jetting water outlet in such a manner that first jetting water and second jetting water alternately occur at peaks of the pulsation of the jetting water, thereby allowing said first jetting water to hit the anus and the private parts in a first area with a first density and said second jetting water to hit the anus and the private parts in a second area with a second density, wherein said first density is higher than said second density, and said first area is smaller than said second area.

2. The sanitary washing apparatus according to claim 1, further comprising:

an amplitude adjuster that adjusts an amplitude of the pulsation of the water jetting from said nozzle to be equal to or smaller than a predetermined value.

3. The sanitary washing apparatus according to claim 1, further comprising:

a water feed pipe that receives supply of water from an external water supply source, wherein a minimum value of the pressure of the water jetting from said jetting water outlet is higher than a pressure of feed water from said water supply source.

4. The sanitary washing apparatus according to claim 1, wherein said flowing water adjuster comprises:

a flow path for feeding pulsating water to said jetting water outlet; and an air mixer that is connected to said flow path and mixes air with the water flowing through the flow path, and said air mixer mixes air with said water in such a manner that the pulsating water jetting from said nozzle includes jetting waters containing different amounts of air that alternately occur at peaks of the pulsation of the water jetting from said nozzle.

5. The sanitary washing apparatus according to claim 1, wherein said flowing water adjuster comprises:

a first flow path for feeding first flowing water that pulsates by cyclically changing pressure to said jetting water outlet; and a second flow path for feeding second flowing water that pulsates by cyclically changing pressure to said jetting water outlet in opposite phase with said first flowing water, said first flowing water jets from said jetting water outlet as said first jetting water, said second flowing water jets from said jetting water outlet as said second jetting water, said first jetting water jetting from said jetting water outlet has a higher density and a smaller cross-sectional area perpendicular to a direction of jetting than said second jetting water, and said second jetting water jetting from said jetting water outlet has a lower density and a larger cross-sectional area perpendicular to the direction of jetting than said first jetting water.

6. The sanitary washing apparatus according to claim 5, wherein said flowing water adjuster comprises:

an air mixer that is connected to said first flow path and said second flow path and mixes air with each of said first flowing water and said second flowing water, and an amount of air mixed with said second flowing water at said jetting water outlet is larger than an amount of air mixed with said first flowing water.

7. The sanitary washing apparatus according to claim 5, wherein said flowing water adjuster feeds said first flowing water and said second flowing water to said jetting water outlet by making said first flowing water and said second flowing water swirl, and a degree of swirling of said second flowing water at said jetting water outlet is higher than a degree of swirling of said first flowing water.

8. The sanitary washing apparatus according to claim 7, wherein said first flowing water at said jetting water outlet is a straight flow.

9. The sanitary washing apparatus according to claim 7, wherein said flowing water adjuster comprises:

a pump that cyclically pressurizes water to make the water pulsate; and a divider that distributes the water pulsated by said pump between said first flow path and said second flow path.

10. The sanitary washing apparatus according to claim 9, wherein said first flow path and said second flow path have different flow path lengths to feed said second flowing water pulsating in opposite phase with said first flowing water to said jetting water outlet.

11. The sanitary washing apparatus according to claim 9, wherein said first flow path and said second flow path have different accumulation pressures to feed said second flowing water pulsating in opposite phase with said first flowing water to said jetting water outlet.

* * * * *